US007488410B2

(12) United States Patent
Bennett et al.

(10) Patent No.: US 7,488,410 B2
(45) Date of Patent: Feb. 10, 2009

(54) ANODE ASSEMBLY FOR CATHODIC PROTECTION

(76) Inventors: John E. Bennett, 10039 Hawthorne Dr., Chardon, OH (US) 44024; Dale W. Griffis, II, 11651 Cherry Hollow, Chardon, OH (US) 44024; Russell J. Bechkowiak, 313 Greenway Dr., Chardon, OH (US) 44024

( * ) Notice: Subject to any disclaimer, the term of this patent is extended or adjusted under 35 U.S.C. 154(b) by 88 days.

(21) Appl. No.: 11/597,388

(22) PCT Filed: May 27, 2005

(86) PCT No.: PCT/US2005/018768

§ 371 (c)(1),
(2), (4) Date: Nov. 24, 2006

(87) PCT Pub. No.: WO2005/121760

PCT Pub. Date: Dec. 22, 2005

(65) Prior Publication Data

US 2007/0194774 A1 Aug. 23, 2007

Related U.S. Application Data

(60) Provisional application No. 60/576,137, filed on Jun. 3, 2004.

(51) Int. Cl.
*C23F 13/06* (2006.01)

(52) U.S. Cl. ..... 205/734; 204/196.37; 204/196.18

(58) Field of Classification Search ..... 204/196.37, 204/196.18; 205/734
See application file for complete search history.

(56) References Cited

U.S. PATENT DOCUMENTS

| | | | | | |
|---|---|---|---|---|---|
| 4,502,929 | A | | 3/1985 | Stewart et al. | 204/147 |
| 4,551,176 | A | | 11/1985 | Skvara et al. | 106/90 |
| 5,292,411 | A | | 3/1994 | Bartholemew et al. | 205/731 |
| 5,609,748 | A | * | 3/1997 | Kotowski et al. | 205/734 |
| 5,650,060 | A | | 7/1997 | Huang et al. | 205/730 |
| 5,910,236 | A | | 6/1999 | Iossel et al. | 204/280 |
| 6,022,469 | A | * | 2/2000 | Page | 205/734 |
| 6,165,346 | A | | 12/2000 | Whitmore | 205/734 |

(Continued)

OTHER PUBLICATIONS

NACE Corrosion 98, Paper #640; J.E.Bennett; Mar. 25, 1998.

*Primary Examiner*—Bruce F Bell
(74) *Attorney, Agent, or Firm*—James A. Lucas; Driggs, Hoff, Daugherty & Del Zoppo Co., LPA

(57) ABSTRACT

The deterioration of reinforced concrete structures by galvanic corrosion adversely affects roads, bridges, parking garages and buildings that use reinforcing steel in their construction. Galvanic cathodic protection is typically provided for such reinforced concrete structures using embedded sacrificial anodes, such as zinc, aluminum, and alloys thereof. Disclosed herein is an anode assembly (10) for cathodic protection of a reinforced concrete structure. The assembly comprises at least one sacrificial anode member (12). The anode member is covered with an ionically-conductive covering material (14) into which is bound an electrochemical activating agent at least partly covering the sacrificial anode member. One side (26) of the ionically-conductive covering material is configured to conform closely to a steel reinforcing bar. The conforming side has a non-conductive barrier (16) as an integral part of the covering material. Electrical connectivity is established between the anode member and a ferrous reinforcing bar (20) using conductive wires (18).

21 Claims, 1 Drawing Sheet

U.S. PATENT DOCUMENTS 6,217,742 B1 4/2001 Bennett ..... 205/734
6,793,800 B2 9/2004 Whitmore ..... 205/734
6,958,116 B1 * 10/2005 Bennett ..... 205/734
2004/0238376 A1 * 12/2004 Whitmore ..... 205/734

* cited by examiner

ANODE ASSEMBLY FOR CATHODIC PROTECTION

TECHNICAL FIELD

This invention generally relates to the field of galvanic cathodic protection of steel embedded in concrete structures, and is particularly concerned with the performance of embedded sacrificial anodes, such as zinc, aluminum, and alloys thereof.

BACKGROUND ART

The problems associated with corrosion-induced deterioration of reinforced concrete structures are now well understood. Steel reinforcement has generally performed well over the years in concrete structures, such as bridges, buildings, parking structures, piers, and wharves, since the alkaline environment of concrete causes the surface of the steel to "passivate" such that it does not corrode. Unfortunately, since concrete is inherently somewhat porous, exposure to salt over a number of years results in the concrete becoming contaminated with chloride ions. Salt is commonly introduced in the form of seawater, set accelerators, or deicing salt.

When the chloride reaches the level of the reinforcing steel, and exceeds a certain threshold level for contamination, it destroys the ability of the concrete to keep the steel in a passive, non-corrosive state. It has been determined that a chloride concentration of 0.6 Kg per cubic meter of concrete is a critical value above which corrosion of the steel can occur. The products of corrosion of the steel occupy two and one-half to four times the volume of the original steel, and this expansion exerts a tremendous tensile force on the surrounding concrete. When this tensile force exceeds the tensile strength of the concrete, cracking and delaminations develop. With continued corrosion, freezing and thawing, and traffic pounding, the utility or integrity of the structure is finally compromised and repair or replacement becomes necessary. Reinforced concrete structures continue to deteriorate at an alarming rate. In a recent report to the United States Congress, the Federal Highway Administration reported that of the nation's 577,000 bridges, 266,000 (39% of the total) were classified as deficient, and that 134,000 (23% of the total) were classified as structurally deficient. Structurally deficient bridges are those that are closed, restricted to light vehicles only, or that require immediate rehabilitation to remain open. The damage on most of these bridges is caused by corrosion. The United States Department of Transportation has estimated that $90.9 billion will be needed to replace or repair the damage on these existing bridges.

Many solutions to this problem have been proposed, including higher quality concrete, improved construction practices, increased concrete cover over the reinforcing steel, specialty concretes, corrosion inhibiting admixtures, surface sealers, and electrochemical techniques, such as cathodic protection and chloride removal. Of these techniques, only cathodic protection is capable of controlling corrosion of reinforcing steel over an extended period of time without complete removal of the salt-contaminated concrete.

Cathodic protection reduces or eliminates corrosion of the steel by making it the cathode of an electrochemical cell. This results in cathodic polarization of the steel, which tends to suppress oxidation reactions (such as corrosion) in favor of reduction reactions (such as oxygen reduction). Cathodic protection was first applied to a reinforced concrete bridge deck in 1973. Since then, understanding and techniques have improved, and today cathodic protection has been applied to over one million square meters of concrete structure worldwide. Anodes, in particular, have been the subject of much attention, and several different types of anodes have evolved for specific circumstances and different types of structures.

The most commonly used type of cathodic protection system is impressed current cathodic protection (ICCP), which is characterized by the use of inert anodes, such as carbon, titanium suboxide and, most commonly, catalyzed titanium. This protection system also requires the use of an auxiliary power supply to cause protective current to flow through the circuit, along with attendant wiring and electrical conduit. This type of cathodic protection has been generally successful, but problems have been reported with reliability and maintenance of the power supply. Problems have also been reported relating to the durability of the anode itself, as well as the concrete immediately adjacent to the anode, since one of the products of reaction at an inert anode is acid ($H^+$). Acid attacks the integrity of the cement paste phase within concrete. Finally, the complexity of ICCP systems requires additional monitoring and maintenance, which results in additional operating costs.

A second type of cathodic protection, known as galvanic cathodic protection (GCP), offers certain important advantages over ICCP. This galvanic cathode protection uses sacrificial anodes, such as zinc and aluminum, and alloys thereof, which have inherently negative electrochemical potentials. When such anodes are used, protective current flows in the circuit without need for an external power supply since the reactions that occur are thermodynamically favored. The system, therefore, requires no rectifier, external wiring or conduit. This simplicity increases reliability and reduces initial cost, as well as costs associated with long term monitoring and maintenance. Also, the use of GCP to protect high-strength prestressed steel from corrosion is considered inherently safe from the standpoint of hydrogen embrittlement. Recognizing these advantages, the Federal Highway Administration issued a Broad Agency Announcement (BAA) in 1992 for the study and development of sacrificial anode technology applied to reinforced and prestressed bridge components. As a result of this announcement and the technology that was developed because of this BAA, interest in GCP has greatly increased over the past few years.

In PCT Published Application WO94/29496 and in U.S. Pat. No. 6,022,469 by Page, a method of galvanic cathodic protection is disclosed wherein a zinc or zinc alloy anode is surrounded by a mortar containing an agent to maintain a high pH in the mortar surrounding the anode. This agent, specifically lithium hydroxide (LiOH), serves to prevent passivation of the zinc anode and maintain the anode in an electrochemically active state. In this method, the zinc anode is electrically attached to the reinforcing steel causing protective current to flow and mitigating subsequent corrosion of the steel.

In U.S. Pat. No. 5,292,411, Bartholomew et al disclose a method of patching an eroded area of concrete comprising the use of a metal anode having an ionically conductive hydrogel attached to at least a portion of the anode. In this patent, it is taught that the anode and the hydrogel are flexible and are conformed within the eroded area, the anode being in elongated foil form.

In U.S. patent application Ser. No. 08/839,292 filed on Apr. 17, 1997 by Bennett, the use of deliquescent or hygroscopic chemicals, collectively called "humectants" is disclosed to maintain a galvanic sprayed zinc anode in an active state and delivering protective current. In U.S. Pat. No. 6,033,553, two of the most effective such chemicals, namely lithium nitrate and lithium bromide ($LiNO_3$ and LiBr), are disclosed to enhance the performance of sprayed zinc anodes. And in U.S.

Pat. No. 6,217,742 B1, issued Apr. 17, 2001, Bennett discloses the use of $LiNO_3$ and LiBr to enhance the performance of embedded discrete anodes. And finally, in U.S. Pat. No. 6,165,346, issued Dec. 26, 2000, Whitmore broadly claims the use of deliquescent chemicals to enhance the performance of the apparatus disclosed by Page in U.S. Pat. No. 6,022,469.

In PCT application Serial No. PCT/US02/30030, filed Sep. 20, 2002, a method of cathodic protection of reinforcing steel is disclosed comprising a sacrificial anode embedded in an ionically conductive compressible matrix designed to absorb the expansive products of corrosion of the sacrificial anode metal.

In U.S. Pat. No. 6,572,760 B2, issued Jun. 3, 2003, Whitmore discloses the use of a deliquescent material bound into a porous anode body, which acts to maintain the anode electrochemically active, while providing room for the expansive products of corrosion. The same patent discloses several mechanical means of making electrical connection to the reinforcing steel within a hole drilled into the concrete covering material. Many of these means involve driven pins, impact tools, and other specialized techniques. These techniques are all relatively complex and difficult to perform.

Finally, in U.S. Pat. No. 6,193,857, issued Feb. 27, 2001, Davison et al describe an anode assembly comprising a block of anode material cast around an elongated electrical connector (wire). Contact is made between the elongated connector and the reinforcing steel by winding the connector around the reinforcing steel and twisting the ends of the connector together using a twisting tool. This form of connection is simpler, and easier to execute than those of Whitmore, but is still laborious and time-consuming on site.

The anodes described above and the means of connection disclosed have become the basis for commercial products designed to extend the life of patch repair and to cathodically protect reinforced concrete structures from corrosion. But the configuration of the devices currently sold is not convenient for installation in actual patch repair. The commercial devices measure 2.5 inches (64 mm) in diameter by 1.25 inches (32 mm) thick, and are intended to mount against exposed reinforcing steel in patch repair. Installation of a device with this configuration does not conform well to established specifications for concrete repair. For example, Ohio Department of Transportation (ODOT) TS-519 specifications require a minimum of 1.25 inches (32 mm) of concrete cover over reinforcing bars, and excavation of concrete to 0.75 inch (19 mm) behind reinforcing bars. If the device currently sold is mounted against a reinforcing bar in vertical configuration, then the top of the device will be exposed if the concrete cover is minimum. On the other hand, if the device is mounted against and beneath the reinforcing bar in horizontal configuration, this will require the installer to chip out at least an additional 0.375 inch (10 mm) behind the bar to make room for the device, and even then patch concrete will not completely encapsulate the device unless even more concrete is removed. This results in considerable additional installation expense.

Mounting the device currently sold directly against the reinforcing bar creates another serious problem. Protective current will tend to flow to the reinforcing bars where the resistance path is lowest, and so a large portion of the current will "dump" directly to the bar against which the device is mounted. This diminishes protective current flow to the reinforcing steel outside the patch, where current and protection are more needed. It also has the effect of shortening anode life, since it causes total current to increase needlessly. This problem is sometimes averted in the field by coating the steel where the device is mounted with non-conductive epoxy, but this process is time consuming and messy, and is seldom used.

DISCLOSURE OF INVENTION

The present invention relates to a method of cathodic protection of reinforced concrete and, more particularly, to a method of improving the performance and service life of embedded anodes prepared from sacrificial metals, such as zinc, aluminum, and alloys thereof. The present invention more specifically relates to a method of cathodic protection wherein the performance of the sacrificial anode is enhanced by the use of deliquescent or hygroscopic chemicals, known collectively as humectants, or by the use of alkaline hydroxides in quantity sufficient to raise the alkalinity of the covering material above about pH 13.3.

The present invention also relates to a configuration that allows intimate and secure mounting of a device against an exposed reinforcing bar, the device having dimensions that permit convenient installation in the field while conforming to typical concrete repair specifications.

The present invention also includes a non-conductive barrier as an integral part of the device, the barrier being the part of the device that is mounted against the reinforcing bar. The barrier serves the purpose of preventing the needless flow of current to the reinforcing bar adjacent to the device. The barrier also serves the purpose of preventing the active chemicals present in the device from coming in direct contact with the reinforcing steel.

Additional details and features of the present invention will become evident in the description of preferred embodiments that follow.

BRIEF DESCRIPTION OF THE DRAWINGS

The present invention can be more completely understood with reference to the two drawings in which.

Further features of the present invention will become apparent to those skilled in the art to which the present invention relates from reading the following specification with references to the accompanying drawings.

MODES FOR CARRYING OUT THE INVENTION

Figure 1:
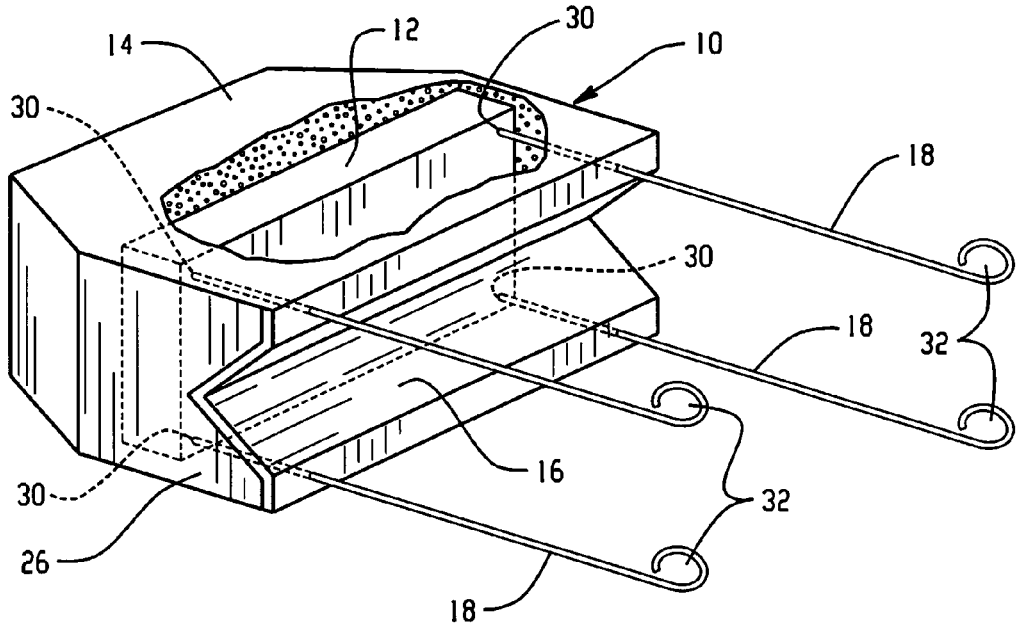
FIG. 1 is an isometric view, partially in cross section, showing details of the present invention.

FIG. 1 is a drawing showing an example of an anode assembly 10 of the present invention containing a sacrificial anode or anodes 12 surrounded by an activated mortar 14 designed to keep the sacrificial anode(s) electrochemically active. A non-conductive barrier 16 is positioned on one side of the device, the barrier being configured at 26 to fit securely against a reinforcing bar (shown in FIG. 2). Although the barrier 16 shown is V-shaped to conveniently fit several sizes of rebar, other cross sections, such as semi-circular for example, will be apparent to those skilled in the art. Tie wires 18 are shown that protrude through or adjacent to the barrier 16, the wires 18 being attached to the sacrificial anodes at 30 by suitable means, such as soldering. The opposite ends of the wires are provided with loops 32 for the purpose of wrapping securely around a reinforcing bar to make an electrical connection.

Figure 2:
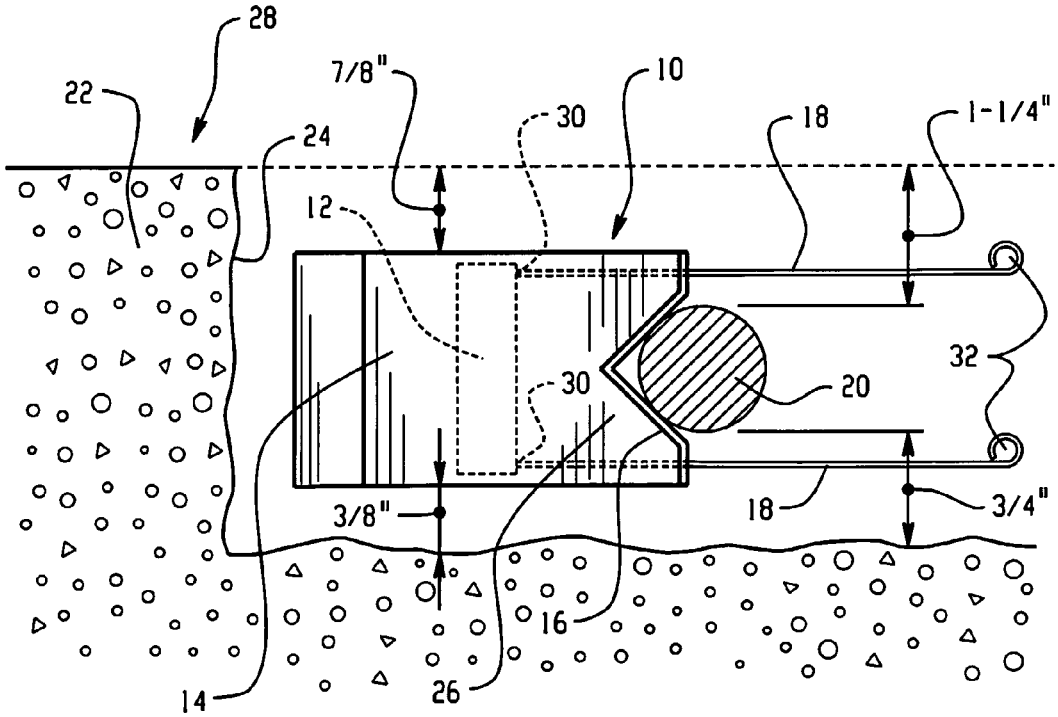
FIG. 2 is an elevational view of the present invention as installed.

FIG. 2 is a drawing showing a side view of the anode assembly 10 of the present invention embedded in a reinforced concrete structure 28. The anode assembly 10 contains a sacrificial anode or anodes (12 shown in outline) surrounded by an activated mortar 14. The non-conductive barrier 16 is positioned on one side of the device, the barrier being configured at 26 to fit securely against a reinforcing bar 20. Tie wires 18 are shown that protrude through or adjacent to the barrier 16, the wires 18 being attached at one end to the sacrificial anodes 12 at 30 inside the device. The other end of the wires 18 are provided, for example, with loops 32 for the purpose of wrapping securely around a reinforcing bar 20 to make an electrical connection. The tie wires 18 are shown not yet wrapped. The device is shown positioned in an excavation 24 in original concrete 22. FIG. 2 shows how the configuration of the device allows mounting onto the reinforcing bar in a way that allows adequate concrete cover over the device, and also adequate room below the device for minimum excavation of concrete. Although not shown in the drawing, it is understood that before the assembly 10 is embedded in fresh concrete, the tie wires 18 are wrapped tightly around the reinforcing bar 20. Tools for this purpose are well known in the art and are readily available.

The present invention relates broadly to all reinforced concrete structures with which cathodic protection systems are useful. Generally, the reinforcing metal in a reinforced concrete structure is carbon steel. However, other ferrous-based metals can also be used.

The anode assembly and method of connection of the present invention relates to galvanic cathodic protection (GCP), that is, cathodic protection utilizing anodes consisting of sacrificial metals, such as zinc, aluminum, magnesium, or alloys thereof. Of these materials, zinc or zinc alloys are preferred for reasons of efficiency, longevity, driving potential and cost. Sacrificial metals are capable of providing protective current without the use of ancillary power supplies, since the reactions that take place during their use are thermodynamically favored.

The sacrificial metal anodes may be of various geometric configurations, such as flat plate, expanded or perforated sheet, or cast shapes of various designs. It is generally beneficial for the anodes to have a high anode surface area, that is, a high area of anode-concrete interface. Preferably, the anode surface area should be from three to six times the superficial surface area, whereas the anode surface area for plain flat sheet is two times the superficial surface area (counting both sides of the sheet).

Since sacrificial metal anodes tend to passivate in the alkaline environment of concrete, it is necessary to provide an activating agent to maintain the anode in an electrochemically active and conductive state. The activating agent proposed by Page in U.S. Pat. No. 6,022,469 is an alkali, such as lithium hydroxide, to maintain the pH of the mortar surrounding the anode above about pH 14. In U.S. patent application Ser. No. 08/839,292 filed on Apr. 17, 1997 by Bennett, the use of deliquescent or hygroscopic chemicals, collectively called "humectants", is disclosed to maintain a galvanic sprayed zinc anode in an active state and delivering protective current. Examples of such chemicals are lithium acetate, zinc bromide, zinc chloride, calcium chloride, potassium chloride, potassium nitrite, potassium carbonate, potassium phosphate, ammonium nitrate, ammonium thiocyanate, lithium thiocyanate, lithium nitrate, lithium bromide, and the like. Other effective chemicals for this purpose will become obvious to those skilled in the art. In U.S. Pat. No. 6,033,553, two of the most effective such chemicals, namely lithium nitrate and lithium bromide ($LiNO_3$ and LiBr), are disclosed to enhance the performance of sprayed zinc anodes. And in U.S. Pat. No. 6,217,742 B1, issued Apr. 17, 2001, Bennett discloses the use of $LiNO_3$ and LiBr to enhance the performance of embedded discrete anodes. It has been found that a mixture of lithium nitrate and lithium bromide is particularly effective to enhance the performance of zinc anodes.

The devices presently used in this application are configured as small blocks, about 2.5 inches (64 mm) in diameter and about 1.25 inch (32 mm) thick. Wires protrude on opposite sides of the block for the purpose of making electrical attachment to a steel reinforcing bar. Installation of a device with this size and shape does not conform well to established specifications for concrete repair. For example, Ohio Department of Transportation (ODOT) TS-519 specifications require a minimum of 1.25 inches (32 mm) of concrete cover over reinforcing bars, and excavation of concrete to 0.75 inch (19 mm) behind reinforcing bars. If the device currently sold is mounted against a reinforcing bar in vertical configuration, then the top of the device will be exposed if the concrete cover is minimum. On the other hand, if the device is mounted against and beneath the reinforcing bar in horizontal configuration, this will require the installer to chip out at least an additional 0.375 inch (10 mm) behind the bar to make room for the device, and even then patch concrete will not completely encapsulate the device unless even more concrete is removed. This results in considerable additional installation expense.

INDUSTRIAL APPLICABILITY

The devices of the present invention conform well to typical specifications for concrete repair, as can be readily understood by reference to FIG. 2. If the device of the present invention is 1.25 inches (32 mm) deep, the reinforcing bar is 0.50 inch (13 mm) in diameter, for example, and the concrete cover over the reinforcing bar is the minimum 1.25 inches (32 mm), then the cover over the device will be an acceptable 0.875 inch (22 mm). Even if the space beneath the reinforcing bar is excavated to the minimum 0.75 inch (19 mm), the clearance between the device of the present invention and the concrete behind the bar will still be 0.375 inch (10 mm). Thus, the devices of the present invention can be easily installed without additional chipping of concrete, and without risk of exposure of the device at the surface of the patch material.

This invention also discloses a configuration of a device that mounts easily and securely to reinforcing bars of various sizes. As shown by example in FIGS. 1 and 2, one side of the device has a long indentation that is "V" shaped in cross section along one side of the device. This shape conforms well to various diameters of reinforcing bars, and results in a secure and repeatable mount of the device to the bar. Other cross sections, such as a semicircle or rectangle, may also be envisioned.

The present invention also discloses a non-conductive barrier incorporated into the side of the device adjacent to the reinforcing bar. Such non-conductive barrier may be conveniently constructed of plastic, such as polyvinyl chloride (PVC), polyvinyl dichloride (PVDC), polypropylene, polyethylene, acrylonitrile-butadiene-styrene (ABS), epoxy, or the like. The non-conductive barrier is in intimate contact with the reinforcing bar and preferably extends along at least about 4 centimeters of the reinforcing bar. The non-conductive barrier prevents a large amount of current from "dumping" directly into the reinforcing steel directly adjacent to the device. Such dumping is undesirable since it reduces the amount of current that flows to reinforcing steel outside the patch, where it is more critically needed to prevent ongoing corrosion. Dumping of current to adjacent steel also results in higher total current flow and, thus, needlessly reduces the effective lifetime of the anode. Although the thickness of the non-conductive barrier is not critical, a thickness of about 1/16 inch (1.6 mm) has been found to work satisfactorily.

From the above description of the invention, those skilled in the art will perceive improvements, changes and modifications. Such improvements, changes and modifications within the skill of the art are intended to be covered by the appended claims below.

Having described the invention, the following is claimed:

1. A method for the galvanic cathodic protection of a reinforced concrete structure, comprising:

providing at least one sacrificial anode member;

embedding said at least one sacrificial anode member(s) in an ionically-conductive covering material, into which is bound an electrochemical activating agent, wherein said ionically-conductive covering material is configured to conform closely and securely to a steel reinforcing bar;

providing a barrier on one side of the ionically-conductive covering material to reduce the passage of current to an adjacent portion of said reinforcing bar; and connecting an elongated metallic conductor between the sacrificial anode member and the reinforcing bar of the reinforced concrete structure, thus causing protective current to flow.

2. The method of claim 1 wherein said at least one sacrificial anode member is zinc or a zinc alloy.

3. The method of claim 1 wherein said at least one sacrificial anode member is a high surface area structure having an actual surface area from three to six times that of its superficial surface area.

4. The anode assembly of claim 1 wherein the electrochemical activating agent is an alkaline hydroxide present in sufficient amount to raise the pH of the covering material above about pH 13.3.

5. The anode assembly of claim 1 wherein the electrochemical activating agent is a deliquescent or hygroscopic material.

6. The method of claim 1 characterized in that the side of the ionically-conductive covering material that conforms closely to the steel reinforcing bar has a non-conductive barrier as an integral part of the covering material.

7. The method of claim 6 characterized in that the cross section of the non-conductive baffler material is a "V" shape and extends essentially the length of one side of the ionically-conductive covering material.

8. The method of claim 6 characterized in that the non-conductive barrier is in intimate contact with the steel reinforcing bar and extends along at least about 4 centimeters of the steel reinforcing bar.

9. The method of claim 1 wherein the ionically conductive covering material is configured with an indentation to conform closely and securely to the steel reinforcing bar.

10. An anode assembly (10) for galvanic cathodic protection of a reinforced concrete structure (28) comprising:

at least one sacrificial anode member (12);

an ionically-conductive covering material (14) into which is bound an electrochemical activating agent at least partly covering said at least one sacrificial anode member;

a barrier on one side (26) of the ionically-conductive covering material that is non-conductive to reduce the passage of galvanic current to an adjacent portion of a steel reinforcing bar, said barrier being in contact with and configured to conform closely and securely to said a steel reinforcing bar (20).

11. The anode assembly of claim 10 wherein said at least one sacrificial anode member is zinc or a zinc alloy.

12. The anode assembly of claim 10 wherein said at least one sacrificial anode member is a high surface area structure having an actual surface area from three to six times that of its superficial surface area.

13. The anode assembly of claim 10 wherein the electrochemical activating agent is an alkaline hydroxide present in sufficient amount to raise the pH of the covering material above about pH 13.3.

14. The anode assembly of claim 10 wherein the electrochemical activating agent is a deliquescent or hygroscopic material.

15. The anode assembly of claim 14 wherein the electrochemical activating agent is lithium nitrate, lithium bromide, or combinations thereof.

16. The anode assembly of claim 10 characterized in that the cross section of the non-conductive barrier is a "V" shape and extends essentially the length of one side of the ionically-conductive covering material.

17. The anode assembly of claim 10 characterized in that the non-conductive barrier is in intimate contact with the steel reinforcing bar and extends along at least about 4 centimeters of the steel reinforcing bar.

18. The anode assembly of claim 10 further comprising a non-conductive barrier (16) as an integral part of the covering material.

19. The anode assembly of claim 10 wherein the ionically conductive material is configured with an indentation to conform to the steel reinforcing bar.

20. An ionically conductive material (14) in the shape of a block for use in covering a sacrificial anode (12) of an anode assembly (10) for cathodic protection of concrete having a ferrous reinforcing member (20), characterized by a non-conductive barrier (16) separating the reinforcing member from the ionically conductive material, said non-conductive barrier comprising a plastic of sufficient thickness to reduce dumping of electrical current to an adjacent portion of said ferrous reinforcing member.

21. The material according to claim 20 characterized in that the barrier is attached to a surface of the block.

* * * * *